US006353395B1

(12) United States Patent
Duran

(10) Patent No.: US 6,353,395 B1
(45) Date of Patent: Mar. 5, 2002

(54) INTERCONNECTABLE DETECTOR WITH LOCAL ALARM INDICATOR

(75) Inventor: Edward C. Duran, Winfield, IL (US)

(73) Assignee: BRK Brands, Inc., Aurora, IL (US)

( * ) Notice: Subject to any disclaimer, the term of this patent is extended or adjusted under 35 U.S.C. 154(b) by 0 days.

(21) Appl. No.: 09/634,475

(22) Filed: Aug. 8, 2000

(51) Int. Cl.[7] ..... G08B 3/00

(52) U.S. Cl. ..... 340/691.1; 340/632; 340/628; 340/633; 340/634; 340/693; 340/629

(58) Field of Search ..... 340/691.1, 632, 340/628, 633, 634, 693, 629

(56) References Cited

U.S. PATENT DOCUMENTS

| | | | | |
|---|---|---|---|---|
| 4,688,021 A | | 8/1987 | Buck et al. | |
| 4,792,797 A | | 12/1988 | Tanguay et al. | |
| 5,568,129 A | * | 10/1996 | Sisselman et al. | 340/628 |
| 5,705,979 A | * | 1/1998 | Fierro et al. | 340/517 |
| 5,886,638 A | | 3/1999 | Tanguary | |
| 5,889,468 A | * | 3/1999 | Banga | 340/628 |
| 5,933,078 A | | 8/1999 | O'Donnell | |
| 5,969,000 A | | 10/1999 | Tanguay | |
| 6,144,289 A | * | 11/2000 | Le Bel | 340/309.3 |

OTHER PUBLICATIONS

Carton and Manual for Prior Art Firex Model 05000 Smoke Alarm.

Carton and manual for prior art Kidde Model 1275 E Smoke Alarm.

* cited by examiner

*Primary Examiner*—Daniel J. Wu
*Assistant Examiner*—Tai T. Nguyen
(74) *Attorney, Agent, or Firm*—Rockey, Milnamow & Katz, Ltd.

(57) ABSTRACT

A low power local alarm indicating system for interconnectable detectors enables a viewer to, after the fact, determine which detector or detectors had previously gone into a local alarm. An alarm latch, such as a bistable multi-vibrator circuit, is set each time the respective detector goes into a local alarm. Subsequently, if the detector's test switch is activated, a local alarm visual indicator is provided. In a disclosed embodiment, the indication is provided by blinking a light emitting diode on the detector, for a predetermined interval. Where multiple detectors are interconnected, each detector that goes into alarm not only sets its local alarm latch and emits a local alarm, it also generates an interconnect alarm signal to the remaining interconnected detectors. The interconnected detectors go into alarm at least for as long as the interconnect signal is present. If any detector in interconnect alarm receives sufficient local input to go into a local alarm, the respective smoke latch will be set even in the presence of an interconnect input.

31 Claims, 10 Drawing Sheets

UNIT WILL COME OUT OF SILENCE MODE AFTER
1. TIME OUT IN 8-10 MINUTES
2. SMOKE INCREASES ABOVE AN INTERNAL HIGH SMOKE REFERENCE
3. SMOKE DECREASES BELOW THE NORMAL ALARM THRESHOLD
4. TEST SWITCH IS PRESSED WHILE IN SILENCE

FIG. 5

| FIG. 5A | FIG. 5B |
| --- | --- |

INTERCONNECTABLE DETECTOR WITH LOCAL ALARM INDICATOR

FIELD OF THE INVENTION

The invention pertains to interconnectable ambient condition detectors. More particularly, the invention pertains to such detectors which include low power, local alarm indicating circuits.

BACKGROUND OF THE INVENTION

Interconnected smoke detector systems are known. In such systems, a plurality of spaced apart smoke detectors, installed in a region being monitored, are interconnected by conductors. When one detector goes into alarm, it emits an interconnect alarm signal, via the conductors, to the remaining detectors. In this configuration, all of the remaining detectors also go into a remote alarm. The system stays in alarm until the smoke clears and/or the system is reset.

A long term problem has been establishing the detector(s) which have gone into local alarm after the alarm condition has cleared. A faulty detector which has gone into a false alarm will drive all of the remaining detectors to emit an interconnect alarm. In such circumstances, knowing which detector went into local alarm will facilitate the identification and replacement of the faulty unit.

One known solution has been to blink a local light emitting diode on each detector which has gone into a local alarm for the duration of that alarm condition. The blinking ceased however when the respective detector(s) would go out of local alarm. Hence, there would be no after-the-fact record available as to the detector(s) that went into local alarm.

Another known solution has been to provide a two-state device such as an SCR or triac which would conduct in the presence of a local alarm and light an indicator such as a light emitting diode. A gate signal for the SCR or triac has been generated using a signal that activates a local audible output transducer.

Use of an SCR or triac produces an after-the-fact indicator of the presence of a local alarm condition. In such known systems, where an interconnect signal is received before the respective detector goes into local alarm, the interconnect signal is used to inhibit the gate signal. Hence, only the indicator for the first to alarm detector will be energized.

Use of the SCR or triac-type latch turns the indicator on continuously. This represents a power drain that requires a source of AC input power. Hence, such configurations are not suitable for use in battery powered detectors due to high current drain.

There thus continues to be a need for latching circuitry which can indicate, over an extended period of time if need be, which detector(s) in an interconnected system has or have gone into local alarm. Preferably, such circuitry could be configured to require minimal power consumption so that the respective units can be energized off of batteries without requiring the presence of AC-type utility power.

SUMMARY OF THE INVENTION

An interconnectable detector includes a relatively low powered latch circuit which responds to an output signal from a local ambient condition sensor. The latch is set each time that the sensor indicates the presence of a hazardous condition such as fire or gas. This corresponds to a local alarm condition.

The sensor and the latch circuitry are carried within a housing. The housing, in one aspect of the invention, also carries an externally viewable light emitting indicator, such as a light emitting diode. A control circuit couples the sensor to the latch circuitry and to the visual output device.

In yet another aspect of the invention, the housing also carries an interconnect port. The interconnect port transmits alarm indicating signals to other detectors coupled to an intervening communication link, for example, wirelessly or via a wire cable. In response to a first detector going into an alarm condition, and as a result setting its local alarm latch, an interconnect alarm signal is generated. The interconnect alarm signal is transmitted to the remaining detectors coupled to the communication link. Those detectors go into an interconnect alarm. They do not set their respective local alarm latches. This corresponds to a remote or an interconnect alarm.

The latch circuitry is configured such that where a local alarm condition is sensed, that detector's respective alarm latch will be set irrespective of the presence of the interconnect alarm signal. Subsequently, after the system has gone out of alarm due to the alarm causing condition having dissipated, the respective alarm latches which had been set due to detection of the local respective alarm condition remain set.

The state of the respective alarm latch can be interrogated by activating a test switch associated with each detector. Activating the test switch, for example by depressing same, of a detector which has an alarm latch which has been set will result in the local visual indicator being energized so as to indicate, for a period of time such as 10 minutes, for example, that a particular detector had previously gone into a local alarm. At the same time, the respective detector emits an interconnect alarm signal, due to activation of the test switch.

The emitted interconnect alarm signal in turn causes all of the interconnected detectors to go into an interconnect (remote) alarm state for as long as the initial test switch has been activated. When the test switch is de-activated, such as by releasing same, the interconnected detectors go out of alarm. At the same time, any of the interconnected detectors which had their respective alarm latches set will at that time energize their alarm indicator for a pre-set time interval to indicate that those respective detectors had at some prior time gone into a local alarm.

In another aspect of the invention, the visual indicator can be energized intermittently so as to flash rapidly, for example, at a rate of once every one to two seconds for the pre-determined time interval, such as for ten minutes, and then stop. In yet another aspect of the invention, releasing the respective test switch will re-set the associated local alarm latch. Alternately, the local alarm latch can be reset at the end of the ten-minute interval. Also, the alarm latch can be reset, in another embodiment, by activating the test switch a second time.

In yet another aspect of the invention, alarm latches can be implemented as, for example, bi-stable multi-vibrator circuits which exhibit the same energy requirements irrespective of state. As a result of using relatively low power circuitry and blinking the visual output element, a battery can be used as a source of energy.

In another aspect of the invention, the sensor can be implemented as a smoke sensor, a heat sensor or a gas sensor. Smoke sensors can be implemented as either ionization or photoelectric smoke sensors.

The detector can incorporate alarm silencing circuitry for purposes of terminating nuisance alarms. In addition, activation of the test switch will produce a condition for testing portions of the respective detector for as long as the test switch is activated. The test switch can be activated locally, by depressing it, or remotely by a wireless command.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
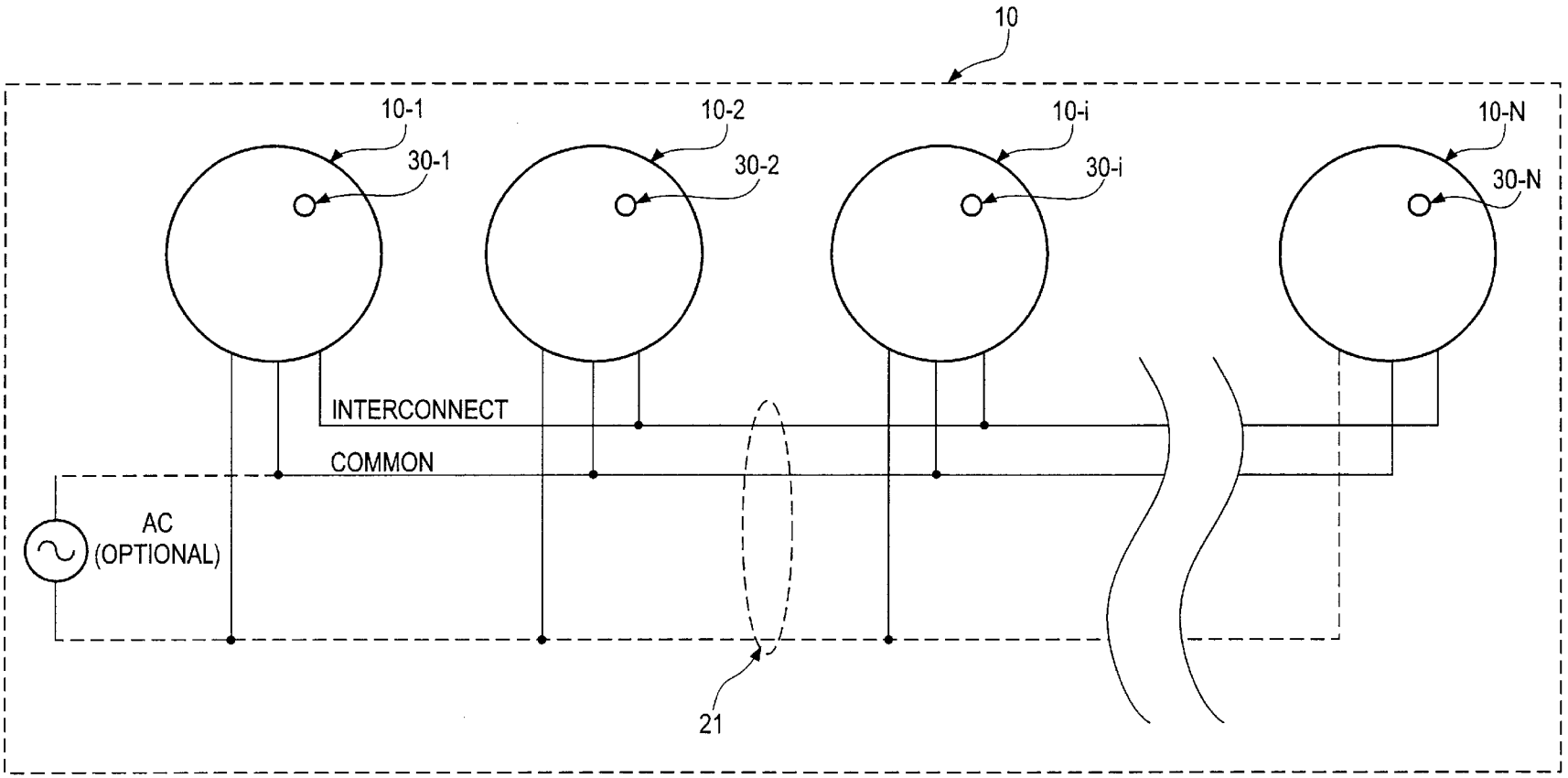
FIG. 1 is a over-all block diagram of system 10 in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

Figure 2:
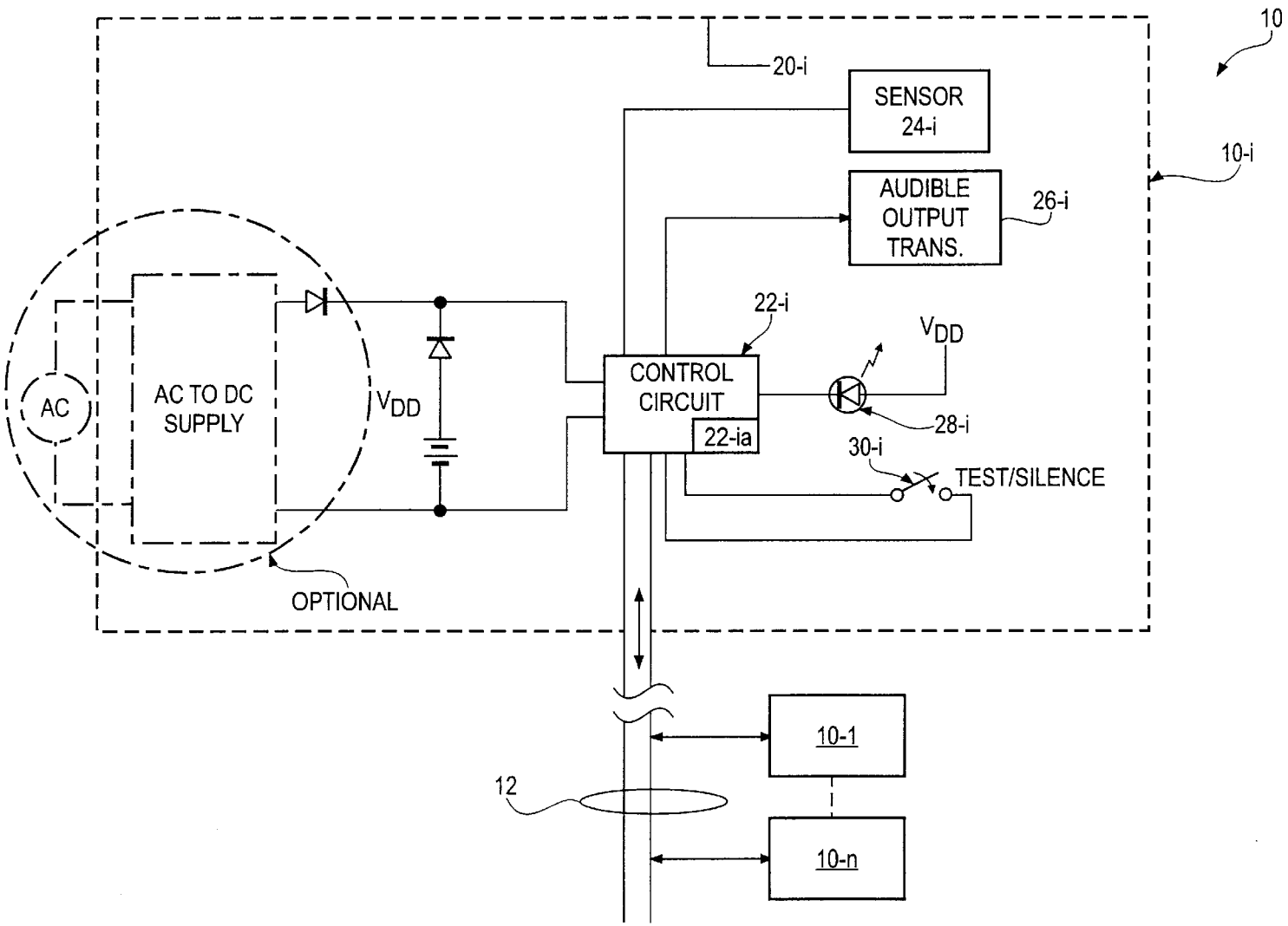
FIG. 2 is a more detailed block diagram of the system of FIG. 1.

FIGS. 1 and 2 illustrate an interconnected detector system 10 in accordance with the present invention. The system 10 includes a plurality of detectors 10-1, 10-2 . . . 10-n.

The detectors can be the same or different depending on the installation. Different detectors can be interconnected so long as they exhibit a common interconnect protocol, described subsequently.

The detectors are all interconnected via a medium such as an electrical cable 12. A wireless medium could also be used. A discussion of the elements of detector 10-i will be sufficient for a discussion of corresponding elements of detectors 10-2 . . . 10-n.

Detector 10-i is carried by a housing 20-i. The housing 20-i supports control circuitry 22-i. Control circuitry 22-i could be implemented as an application specific integrated circuit (ASIC) or as a programmed processor.

Control circuitry 22-i is coupled to a hazardous condition sensor 24-i which could be implemented as a fire sensor, a gas sensor or the like. If implemented as a fire sensor, sensor 24-i could be a smoke sensor, a flame sensor, or a heat sensor. A latch circuit 22-ia is set in response to a detected local alarm condition such as smoke, heat or gas.

Control circuitry 22-i is coupled to an audible output transducer 26-i which can be energized to indicate an alarm condition, an intermittent battery low condition or other conditions as would be known to those of skill in the art. A visual output device, such as a light emitting diode, 28-i is also coupled to control circuitry 22-i. Light emitting diode 28-i provides a visual output of status of the detector 10-i.

Light emitting diode 28-i could be illuminated continuously in the event detector 10-i has locally detected the selected condition and gone into an alarm state. As discussed subsequently, light emitting diode 28-i can be blinked intermittently for a predetermined period of time to indicate that a respective detector has in fact previously gone into a local alarm, It will be understood that other types of visual output devices could be used without departing from the spirit and scope of the present invention.

Also coupled to control circuit 22-i is a test/silence switch 30-i. The switch 30-i can be activated by closing same to test detector 10-i. The switch 30-i can also be used to silence a detector whose audible output transducer is being driven due to, for example, a nuisance alarm.

In the event that detector 10-i goes into an alarm state due to a locally detected alarm condition it, in addition to activating the audible output transducer 26-i and light emitting diode 28-i can also couple an interconnect alarm signal to lines 12. This signal will be received by the remaining detectors 10-2 . . . 10-n causing same to go into an interconnect alarm. In this condition, the respective detectors 10-2 . . . 10-n will emit an audible output alarm and may or may not activate their respective visual output devices.

As discussed in more detail subsequently, control circuit 22-i incorporates the alarm latch 22-ia which is set by control circuit 22-i when it has determined that sensor 24-i is signaling the presence of a respective alarm condition. Representative alarm conditions include the presence of smoke, heat, gas and the like. The alarm latch 22-ia associated with control circuit 22-i in detector 10-i is always set in response to the locally detected condition irrespective of the presence of an interconnect alarm on lines 12.

Once set, the respective alarm latch, such as 22-ia, will remain set until test/silence switch 30-i has been activated and released. In this instance, closing test/silence switch 30-i and then releasing same will cause the control circuit to blink the light emitting diode 28-i intermittently for a predetermined period of time, such as 10 minutes, but only if the local alarm latch 22-ia had previously been set. In order to reset the alarm latch 22-i the test switch is activated again during the predetermined time interval.

The time interval wherein the light emitting diode 28-i blinks makes it possible for somebody monitoring the system 10 to examine each of the detectors 10-1 . . . 10-n to ascertain which of those detectors is blinking its respective visual output device, such as light emitting diode 28-i. The presence of the respective blinking visual output devices is an after-the-fact indicator that the respective detector 10-i had previously gone into a local alarm.

The respective alarm latches such as 22-ia, are not set by an incoming interconnect alarm signal. However, even in the presence of an interconnect alarm signal, where the respective control circuit, such as control circuit 22-i in combination with sensor 24-i, detects the presence of the respective alarm condition, the respective alarm latch 22-ia will be set.

Figure 3:
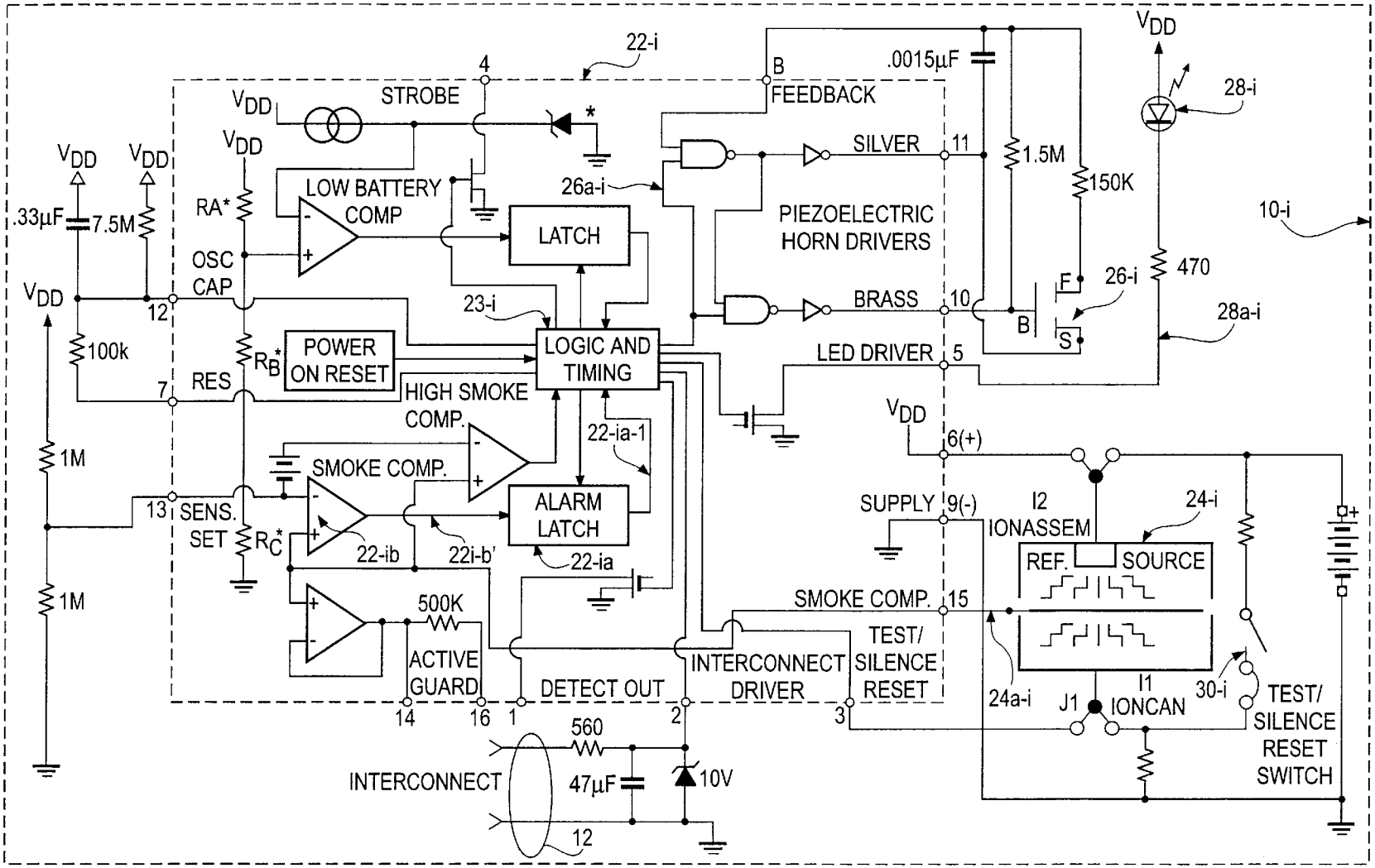
FIG. 3 is more detailed block diagram schematic of a detector in accordance with the present invention.

FIG. 3 illustrates in more detail detector 10-i. The detector 10-i, for exemplary purposes, has been implemented with an ionization-type smoke sensor 24-i and with control circuits 22-i implemented as an application specific integrated circuit. The integrated circuit 22-i includes an alarm latch 22-ia which might be implemented as a bi-stable multi-vibrator. Sensor 24-i could also be implemented as a photoelectric smoke sensor, a heat sensor or a gas sensor without limitation.

Increasing smoke concentrations at the sensor 24-i will, as known to those of skill in the art, cause smoke comparator 22-ib to change state when the concentration exceeds a predetermined threshold. In such an event, via line 22-ib', the alarm latch 22-ia will be set.

It is to be understood that alarm latch 22-ia will be set whenever local smoke is sensed by detector 10-i above a predetermined threshold. Hence, even in the presence of an interconnect alarm on the interconnect lines 12, smoke latch 22-ia will be sensed.

Coupled across sensor 24-i is test/silence reset switch 30-i. Closing the switch 30-i, where the detector 10-i is not in alarm, causes the detector to go into a test mode for as long as the switch 30-i is held closed. In this mode, the functionality of elements of the detector are tested and the audible output transducer 26-i is energized.

While the switch 30-i has been closed, assuming that the alarm latch 22-ia is set, the detector will be tested. When the test switch 30-i is released, LED 28-i will continue blinking for another 10 minutes. If the switch 30-i is again activated, while the LED 28-i is blinking, the alarm latch 22-ia will be reset.

Those of skill will understand that other elements of the integrated circuit 22-i are known in the art and need not be described further.

By way of further explanation in an exemplary circuit, when power is initially applied, the integrated circuit 22-i including alarm latch 22-ia is reset through a power-up reset circuit, which is internal to the integrated circuit. The alarm latch 22-ia will be disabled for a short period of time after initial power-up by a disable circuit generally indicated at 23-i. This will eliminate false setting of the alarm latch 22-ia due to any smoke sensor 24-i overshoot on power-up.

The alarm 22-ia latch is set by the smoke alarm going into local alarm. The latch 22-ia may be set in multiple units which have gone into a local alarm in an interconnected system. The latch 22-ia will remain set until it is reset.

The alarm remember indicator may be activated after the alarm latch 22-ia has been set. The visual output device 28-i will flash, for example once every 1.6 seconds, for ten minutes and then stop.

There are several ways to activate the local alarm remember indicator function, assuming that at least one detector has gone into local alarm. One way is to press and release the test switch 30-i. Following release of the test switch, the output device 28-i will flash for ten minutes.

The indicator function is activated following a local alarm condition. Another way to activate the local alarm is for the smoke alarm to receive an interconnect alarm signal through the interconnect port via lines 12. After the local alarm or remote alarm signal has terminated, the output device 28-i will flash at a rate on the order of once every 1.6 seconds for ten minutes. The alarm latch 22-ia will not be reset.

The silence feature can be used to silence the audible output device 26-i while the detector is in local alarm. Activating the test button 30-i while in local smoke alarm activates the feature. After the test switch 30-i has been is released, the circuit 22-i will compare the smoke sensor voltage to an internal high smoke reference.

If the smoke sensor output voltage is greater than the smoke threshold reference and less than the high smoke reference, the detector will go into the silence mode.

While in the silence mode, the output device 26-i will quit sounding, the interconnect output will go low and the visual output device will flash once every 1.6 seconds.

The high smoke reference is to override the silence function at high levels of smoke. If the smoke sensor output exceeds the internal high smoke reference, the silence function is canceled and the detector will go back into local alarm.

There is only one switch 30-i for test and silence. When the test/silence switch 30-i is depressed, a voltage is imposed on the bottom of the ion chamber. Imposing a voltage on the bottom of the ion chamber raises the center electrode voltage, line 24*a–i*. The silence circuit is designed to make the silence decision based on the normal center electrode voltage value, not the center electrode value with the test/silence switch depressed.

The silence feature logic can be edge triggered. If the test switch 30-i is stuck in the pressed condition, the silence feature will be activated only one time.

Silence is reset by any of the following:

8–10 minute timeout smoke sensor output exceeds internal high smoke reference (High Smoke)

smoke sensor output falls below the smoke threshold reference (No Smoke)

test switch is pressed during silence period (Reset).

FIGS. 4A through 4J are timing diagrams illustrating various operational circumstances and conditions for the detector 10-i.

The line labeled "Smoke" illustrates when the signal on line 22-ib' is indicating the presence of enough smoke to cause the detector to go into local alarm. The line labeled "Alarm Latch" is an output from alarm latch 22-ia, such as on line 22-ia –1.

The line labeled "Horn" illustrates when line 26*a*-i is enabled to drive audible output device 26-i. The line labeled "LED" illustrates when line 28*a–i* is illuminated to indicate an alarm condition (it could be rapidly flashed).

The line labeled "I/O-OUT" illustrates when that unit is generating an interconnect alarm signal to be output to other detectors 10-1 . . . 10-n. The line labeled "I/O-IN" illustrates when the respective detector is receiving an interconnect alarm signal via cable 12, from other detectors in the system. The line labeled "Test SW" indicates when switch 30-i has been activated.

In FIG. 3A detector 10-i is in a standby, quiescent state. At a time t1, smoke in sensor 24-i exceeds the predetermined threshold causing smoke comparator 22-ib to change state. This sets alarm latch 22-ia. Simultaneously, transducer, horn, 26-i is energized and light emitting diode 28-i is blinked indicating the presence of a local alarm condition. Detector 10-i places an interconnect alarm signal (I/O out) onto conductors 12 to cause the remaining detectors in the system 10 to enter an interconnect alarm state.

At a time t2, the local smoke clears and the horn ceases to be energized. The alarm remember indicator flashes and will be active for 10 minuts. The interconnect output signal drops back to low. However, the alarm latch 22-ia remains set.

Figure 4A:
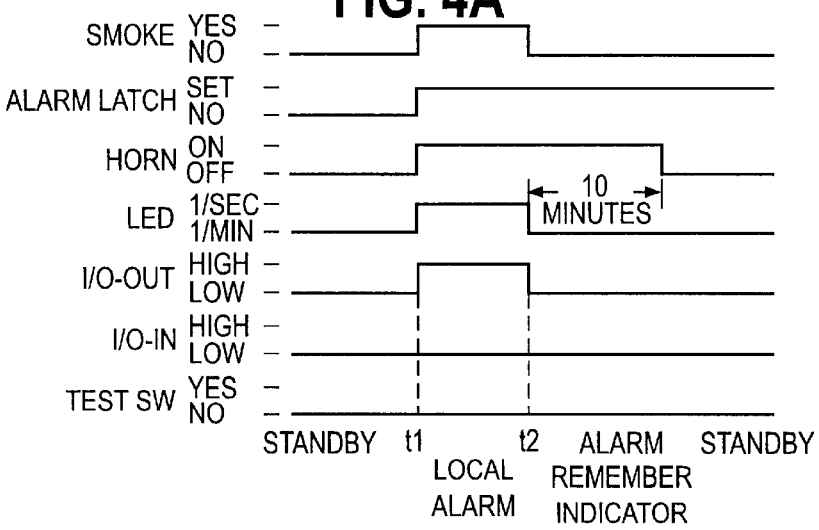
FIGS. 4A through 4J are timing diagrams illustrating operation of detectors such as the detector of FIG. 3.
Figure 4B:
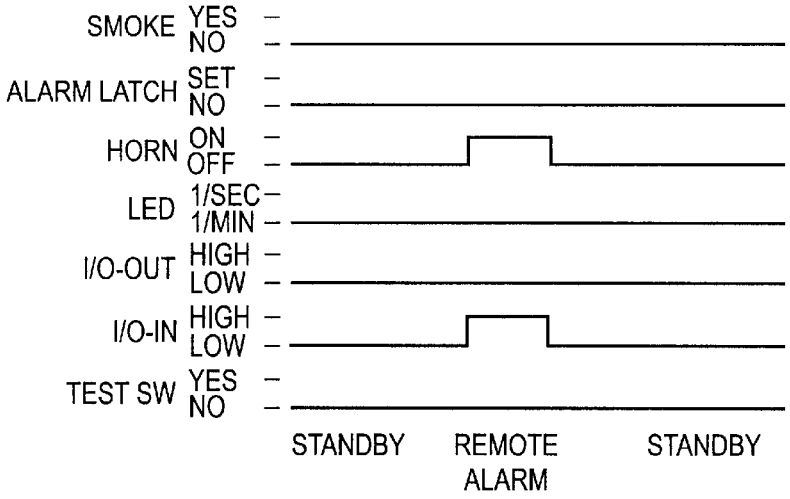
Figure 4C:
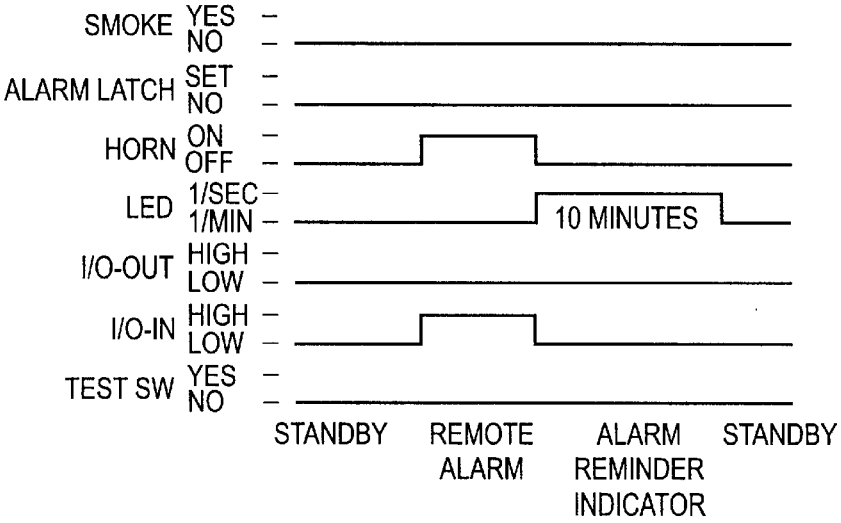
Figure 4D:
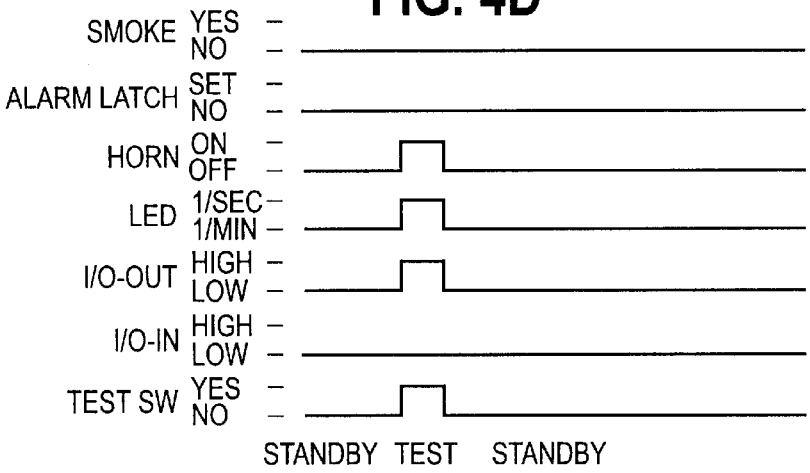
Figure 4E:
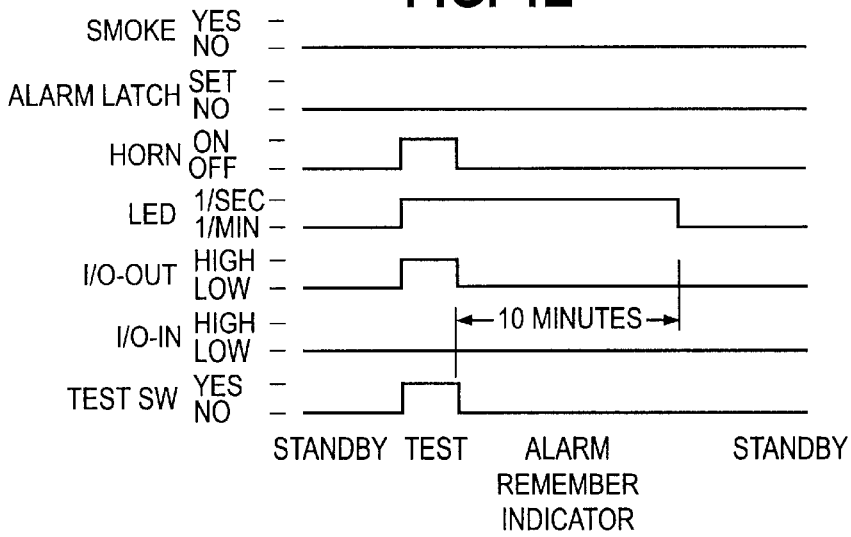

With respect to FIG. 4E, where alarm latch 22-ia had previously been set, and test switch 30-i is activated, horn 26-i is energized for test purposes so long as the switch is held closed or in an activated state. Simultaneously, light emitting diode 28-i is energized and blinks.

When test switch 30-i is released, light emitting diode 28-i continues to blink for 10 minutes at which time it ceases blinking. Hence, where the detector 10-i has gone into a local alarm, this condition can be determined subsequently by depressing the respective test switch 30-i.

When a test switch on a respective detector is activated and released, all of the remaining detectors of the system 10 which have previously set alarm latches, corresponding to latch 22-ia, will blink their respective light emitting diodes, corresponding to light emitting diode 28-i, for the 10 minute interval indicating that those respective detectors had gone into a local alarm. However, none of those respective detectors will reset their alarm latches unless and until their respective test switch has been activated a second time while the respective LED 28-i is blinking.

Figure 4F:
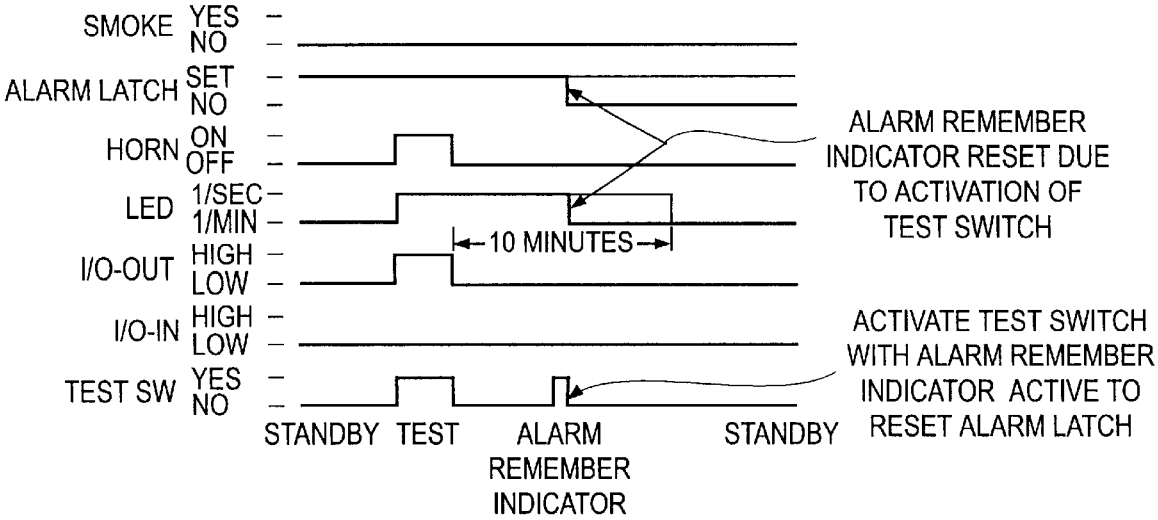
Figure 4G:
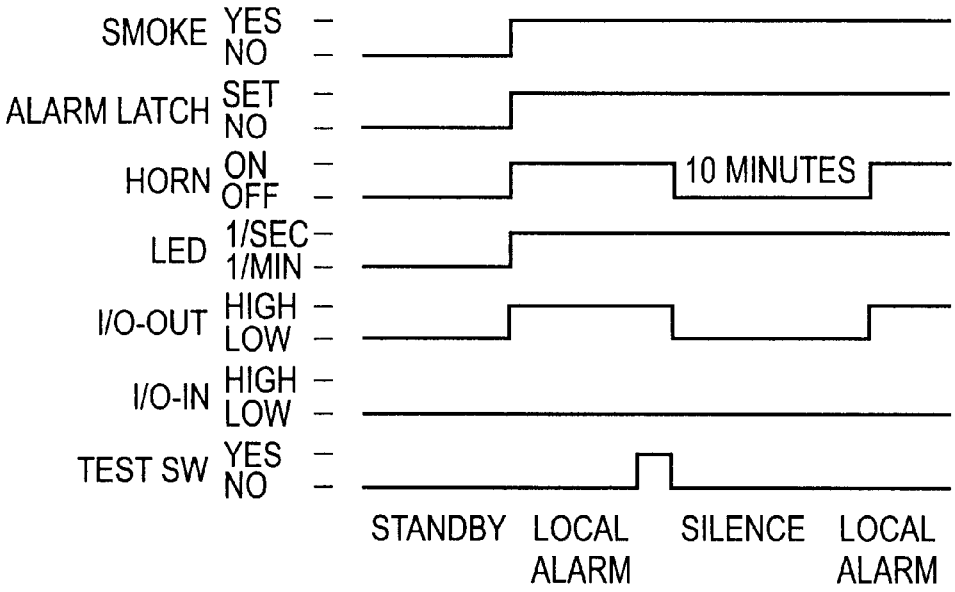
Figure 4H:
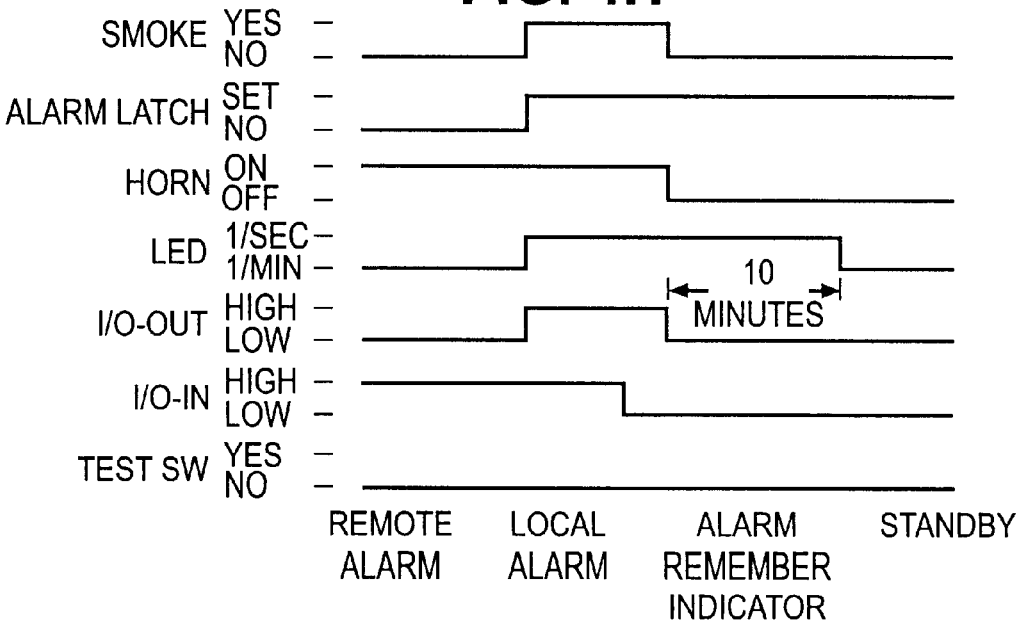
Figure 4I:
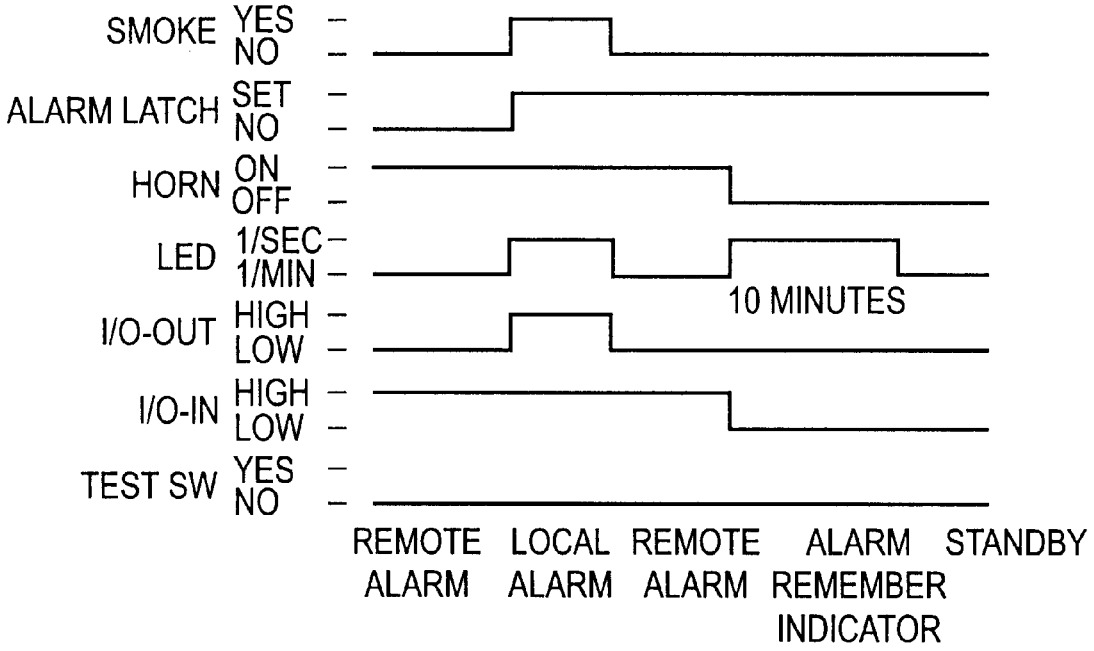
Figure 4J:
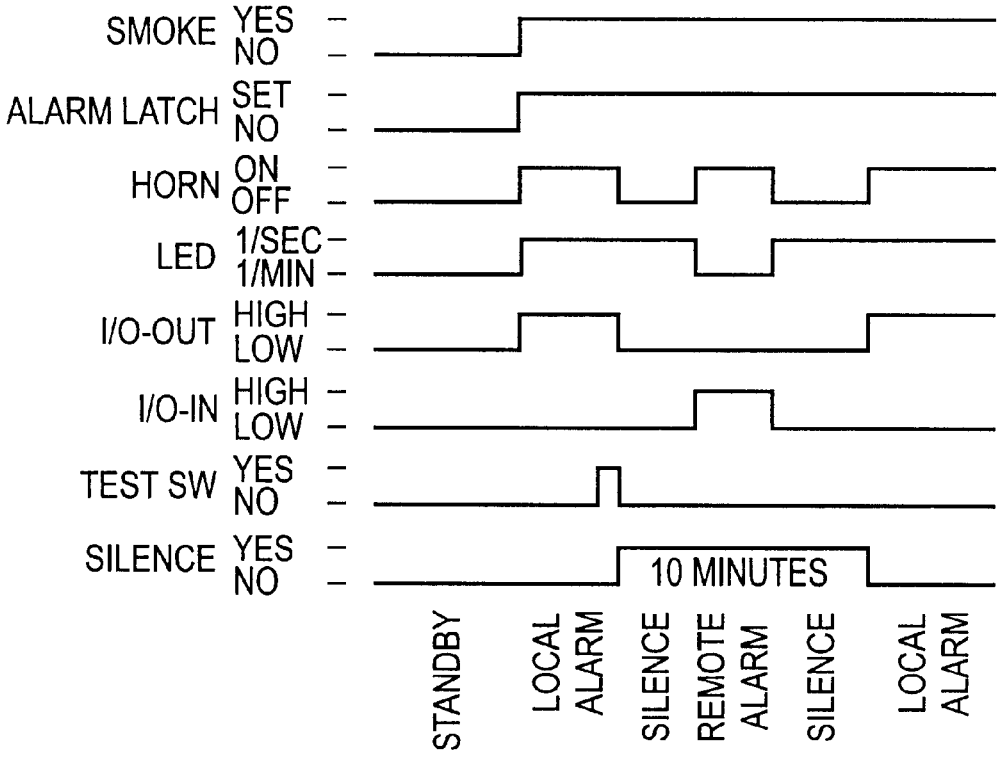

As illustrated in FIG. 4F, activating switch 30-i during the 10 minute blinking interval resets the respective alarm latch 22-ia. It will be understood that time intervals different from the exemplary ten minutes can be used. In addition, other visual or audible indicators of a set alarm latch can be used without departing from the spirit and scope of the present invention.

The remaining timing diagrams illustrate other combinations and conditions as would be understood by those of skill in the art. They need not be discussed in detail.

Figure 5A:
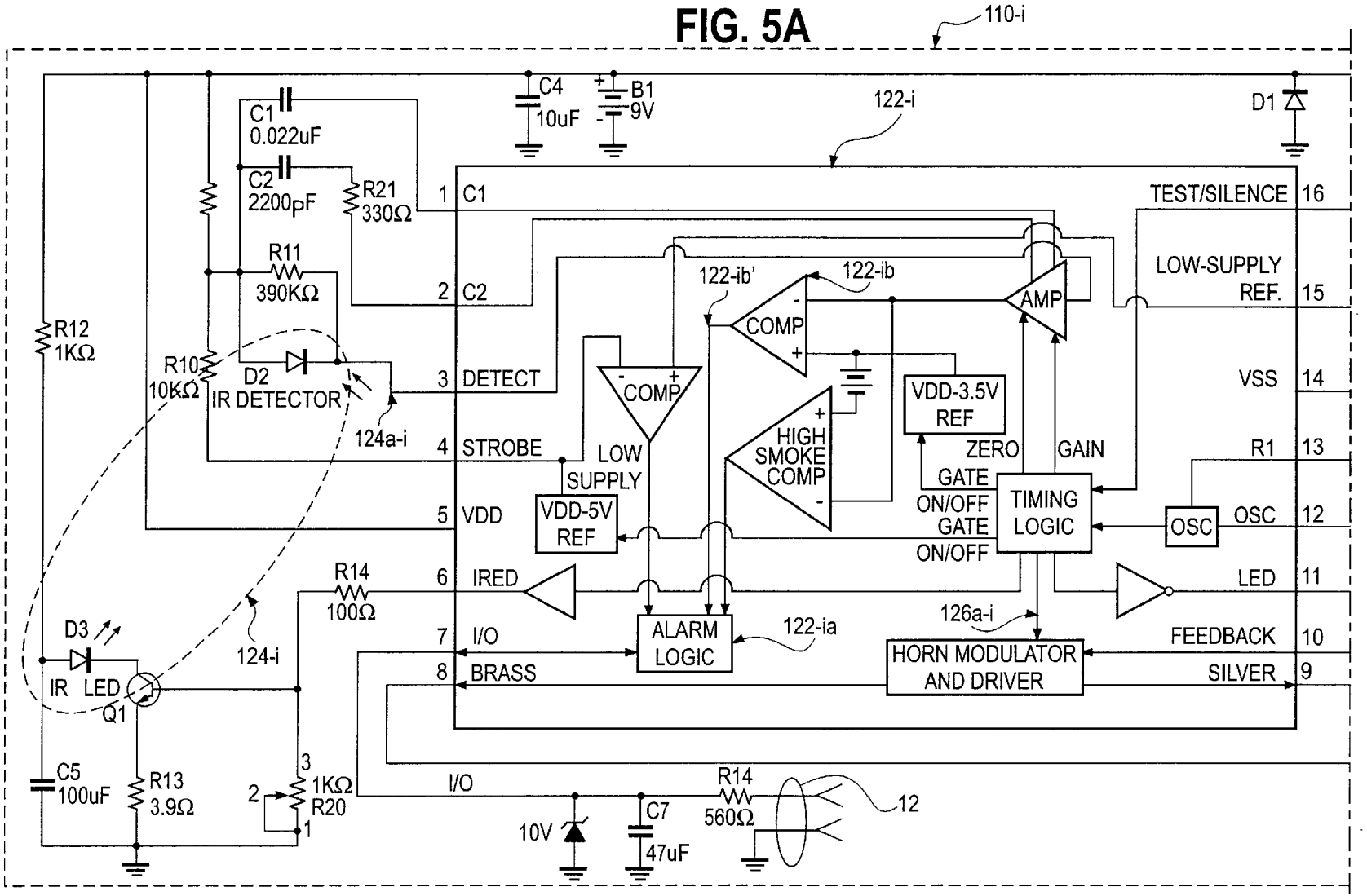
FIG. 5 is a diagram of an alternate detector in accordance with the present invention.
Figure 5B:
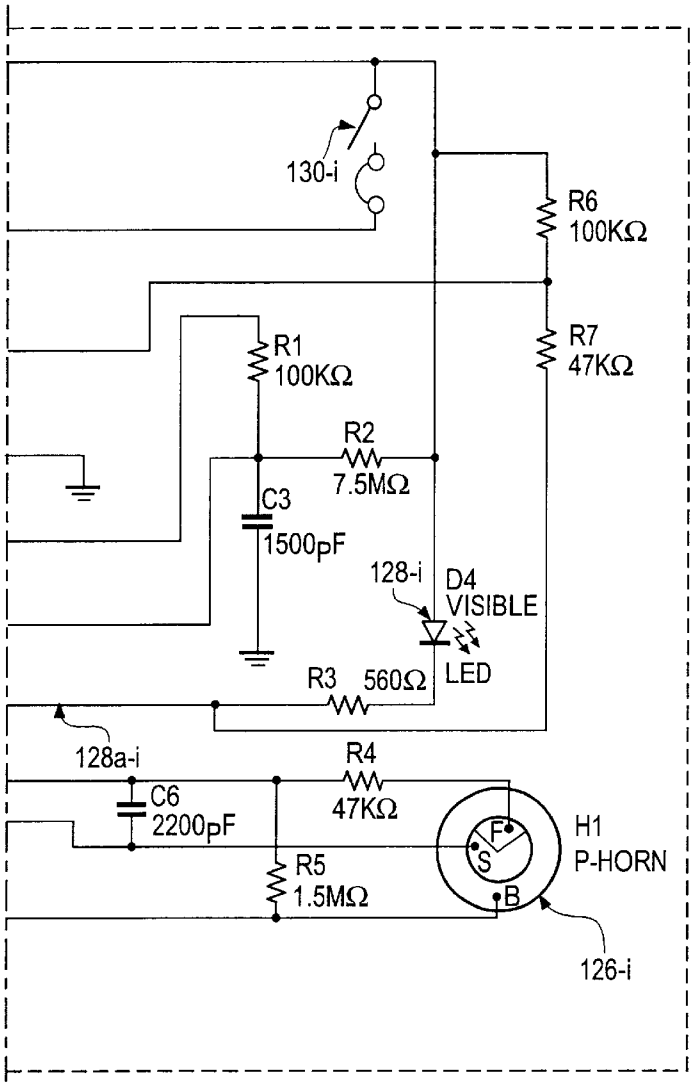

FIG. 5 illustrates a block schematic diagram of a photo-electric detector 110-i usable in the system 10. The detector 110-i includes a photo-electric sensor of a known type 124-i, an audible output device 126-i and a visible light emitting diode 128-i. Other components of the detector 110-i which correspond to previously discussed components or elements of the detector 10-i have been given a similar identification numeral increased by 100. Those elements function in accordance with the previous description of the respective elements of the detector 10-i.

The detector 110-i exhibits the same interconnect protocol signaling as discussed above with respect to the detectors 10-1 . . . 10-n. It will be understood that in addition to detectors having photo-electric sensors, such as the sensor 124-i, detectors having other types of sensors, such as gas or thermal sensors, could also be incorporated in the system 10 without departing from the spirit and scope of the present invention. The nature of the sensor of a respective detector is not a limitation of the present invention. All detectors, however, must be compatible with the previously described interconnect protocol. The interconnect protocol is common to all such detectors irrespective of whether the medium is wireless or wired such as by an electrical or optical cable.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A detector comprising:

an ambient condition sensor for sensing a local ambient condition originating externally of the detector; control circuitry coupled to the sensor, wherein the control circuitry includes a multi-state indicator with one state indicative of a sensed, predetermined ambient condition; and a manually activatable visual indicator, coupled to the control circuitry, for intermittently indicating visually the presence of the one state even in the subsequent absence of the predetermined ambient condition, wherein the manually activatable visual indicator is manually activated independent of the multi-state indicator.

2. A detector as in claim 1 wherein the control circuitry includes a viewer operable input element to activate the visual indicator intermittently for at least a predetermined interval.

3. A detector as in claim 2 wherein the multi-state indicator comprises a two state latch which exhibits a substantially constant current flow in both states.

4. A detector as in claim 1 which includes an interconnect port coupled to the control circuitry wherein that circuitry is responsive to a received interconnect alarm signal without causing the multi-state indicator to assume the one state.

5. A detector as in claim 4 which includes circuitry driving the multi-state indicator to the one state in the presence of both the interconnect alarm signal and a subsequently sensed, predetermined ambient condition.

6. A detector as in claim 5 wherein the control circuitry includes a viewer operable input element to activate the visual indicator intermittently for at least a predetermined interval even in the subsequent absence of the sensed condition.

7. A detector as in claim 5 wherein the multi-state indicator comprises a two state latch which exhibits a substantially constant current flow in both states.

8. A detector as in claim 1 which includes an interconnect port coupled to the control circuitry wherein that circuitry is responsive to a received interconnect alarm signal to produce an audible output alarm signal without causing the multi-state indicator to assume the one state.

9. A detector as in claim 8 which includes a manually activated switch, coupled to the control circuitry, whereupon the visual indicator is intermittently activated for a preset time interval in response to the presence of both a manually activated switch and the multi-state indicator exhibiting the one state.

10. A system of substantially identical interconnected detectors wherein the system comprises:

a plurality of detectors couplable to a link wherein each detector includes a sensor of a selected local, external condition;

wherein the detectors each include a control circuit having a two state storage element which is driven to a first state in response to sensing the selected condition; and wherein the detectors each include a display device, coupled to the control circuit and driven, in response to a viewer's input, for a predetermined time interval to provide an intermittent output, subsequent to the storage element entering the first state, wherein the output indicates that the respective detector responded to a local condition, wherein the viewer's input is received independent of the two state storage element.

11. A system as in claim 10 wherein each detector includes circuitry for responding to a received remotely generated interconnect alarm signal without driving the storage element to the first state such that the display device is not intermittently driven for the time interval in response to the viewer's input.

12. A system as in claim 11 wherein the control circuit in the respective detector responds to the sensing of the selected local condition subsequent to receiving the interconnect alarm signal to thereupon drive the display device intermittently in response to the viewer's input.

13. A system as in claim 12 wherein the control circuit is implemented, at least in part, with an application specific integrated circuit.

14. A system as in claim 10 wherein the control circuit includes circuitry to drive the storage element to the first state in response to the presence of the selected local condition irrespective of the presence of a remotely generated alarm indicating signal.

15. A system as in claim 10 which includes one of a wired medium and a wireless medium extending between at least some of the detectors.

16. A system as in claim 10 wherein the control circuit is implemented, at least in part, with a programmed processor.

17. A system as in claim 15 wherein the wired medium comprises an electrical conductor.

18. A detector as in claim 1 which includes a manually operable control element coupled to a silencing circuit for suppressing selected audible alarms.

19. A detector as in claim 18 wherein at least audible outputs indicative of local alarms can be suppressed.

20. A detector as in claim 19 which incorporates a power supply.

21. A detector as in claim 20 wherein the power supply is, at least in part, replaceable.

22. A detector as in claim 20 wherein the power supply includes input terminals for receipt of electrical energy from an exterior source.

23. A detector comprising:

a housing;

an ambient condition sensor carried by the housing, control circuitry carried by the housing and coupled to the sensor, wherein the control circuitry includes a multi-state indicator with one state indicative of a sensed, alarm condition; and a manually activatable visual indicator carried by housing, coupled to the control circuitry, for intermittently indicating visually the presence of the one state even in the subsequent absence of the alarm condition, wherein the manually activatable visual indicator is manually activated independent of the multi-state indicator.

24. A detector as in claim 23 wherein the control circuitry includes a viewer operable input element to activate the visual indicator intermittently for at least a predetermined interval.

25. A detector as in claim 24 wherein the multi-state indicator comprises a two-state latch which exhibits a substantially constant current flow in both states.

26. A detector as in claim 23 which includes an interconnect port coupled to the control circuitry wherein that circuitry is responsive to a received interconnect alarm signal without causing the multi-state indicator to assume the one state.

27. A detector as in claim 26 which includes circuitry driving the multi-state indicate to the one state in the presence of both the interconnect alarm signal and a subsequently sensed, predetermined ambient condition.

28. A detector as in claim 27 wherein the control circuitry includes a viewer operable input element to activate the visual indicator intermittently for at least a predetermined interval even in the subsequent absence of the sensed alarm condition.

29. A detector as in claim 27 wherein the multi-state indicator comprises a two-state latch which exhibits a substantially constant current flow in both states.

30. A detector as in claim 23 which includes an interconnect port carried by the housing, coupled to the control circuitry wherein that circuitry is responsive to a received interconnect alarm signal to produce an audible output alarm signal without causing the multi-state indicator to assume the one state.

31. A detector as in claim 30 which includes a manually activated switch, coupled to the control circuitry, whereupon the visual indicator is intermittently activated for a preset time interval in response to the presence of both a manually activated switch and the multi-state indicator exhibiting the one state.

* * * * *